United States Patent [19]

Bald et al.

[11] 4,152,919

[45] May 8, 1979

[54] COIL CONVEYOR APPARATUS

[75] Inventors: Wilfried Bald; Hans Pölking, both of Hilchenbach, Fed. Rep. of Germany

[73] Assignee: Schloemann-Siemag Aktiengesellschaft, Düsseldorf, Fed. Rep. of Germany

[21] Appl. No.: 865,935

[22] Filed: Dec. 30, 1977

[30] Foreign Application Priority Data

Dec. 30, 1976 [DE] Fed. Rep. of Germany ..... 2659500

[51] Int. Cl.[2] ..... B21B 41/06; B21B 39/34

[52] U.S. Cl. ..... 72/250; 242/79

[58] Field of Search ..... 72/250, 251, 189; 266/142, 102, 103; 214/16.4 A, 16.4 C, DIG. 4; 242/79

[56] References Cited

U.S. PATENT DOCUMENTS

| | | | |
|---|---|---|---|
| 2,848,124 | 8/1958 | Angell et al. | 242/79 X |
| 3,032,289 | 5/1962 | Fredriksson et al. | 242/79 |
| 3,463,410 | 8/1969 | Carpenter | 242/79 |
| 3,993,201 | 11/1976 | Bauer et al. | 214/16.4 A |

*Primary Examiner*—Milton S. Mehr

*Attorney, Agent, or Firm*—Norman S. Blodgett; Gerry A. Blodgett

[57] ABSTRACT

Apparatus for the transportation of coiled hot rolled strip, especially non-ferrous metal coils, such as aluminum coils, in a cold rolling mill, including an intermediate storage space at a cold rolling train, at the annealing facilities following cold rolling, and at further treatment installations.

7 Claims, 4 Drawing Figures

COIL CONVEYOR APPARATUS

BACKGROUND OF THE INVENTION

Equipment is well-known for conveying the coiled hot rolled strip, especially non-ferrous metal strips, in a cold rolling mill. Such known transportation equipment for these strip coils usually consists mostly of cranes or trackless floor level transportation gear, such as fork lift trucks, by which means the strip coils are carried from the hot rolling mill and then unloaded and stored in a coil storage area. From the coil storage area, the coils are individually brought to a cold rolling train by this same type of transportation means and are then cold rolled. After being recoiled and again formed into cold rolled strip coils, they are carried to another coil storage area for cooling. Depending on the dimensional requirements of the strip, the chemical composition of the rolled metal, the capacity of the rolling mill, etc., this procedure is repeated one or more times before the coil finally enters the annealing furnace and, after annealing, is transferred elsewhere for further processing such as coating. This known method of transportation (with intermediate coil storage at the nonferrous cold rolling mills) is disadvantageous, because of the large space required for the intermediate storage of the hot rolled coils and because of the necessity of assuring that each coil is accurately deposited. Furthermore, because several cold rolling mills might have to be supplied with stock from the intermediate coil storage, several cranes are required for the intermediate storage area. This results not only in additional investment for those cranes, but also creates confusion in the order of treatment of the coils, because those cranes have to work side-by-side. Also, such handling of the strip coils is extremely labor intensive, and even partial automation of the work procedure is not possible.

It is, therefore, an outstanding object of the present invention to avoid to a great extent the disadvantages of the above-described transport system, by making possible an ordered storage of the coils in an intermediate storage area requiring relatively little space, by providing a rational procedure for the necessary movement of the rolled stock in a rolling mill, and arranging the above-mentioned specified equipment in order substantially to reduce the previously-required crane work and to make possible a partial automation of the transportation procedure.

SUMMARY OF THE INVENTION

In general, the present invention solves these problems, because the cold rolling train and the annealing furnaces can be charged by pallet-moving equipment arranged parallel to the rolling line and arranged perpendicular to an intermediate storage consisting of multi-level shelves. Preferably, the loading of the cold rolling train begins with pallet-advancing equipment at the vertically-arranged shelves positioned at the cold rolling mill entry end and ends with pallet-moving equipment located at the exit end of the cold rolling mill at the vertical shelf storage which is located there. Another desirable type of intermediate storage and rolling mill coil shipping area arrangement consists of terminating the tracks for the cars at vertical shelves positioned at the entry end of the cold rolling mill. This makes it possible to use the loading and unloading equipment on the front and the back sides of the vertical shelves of the storage area.

The pallet-moving equipment consists of a suitable transversely-moving platform arranged in an advantageous manner and connected to roller conveyors. Constructed inside the roller conveyors is a lowering mechanism preferably constructed in the form of lifting tables, the unloading equipment advantageously forming the end of a sectional roller table, each lifting table being equipped with a turntable.

Another improvement in accordance with this invention consists of the fact that traveling coil cars are positioned on tracks perpendicular to the roller conveyor of the cold rolling train that is being loaded by the pallet-moving equipment and in alignment with the reel mandrel of the cold rolling train. Strip coils can be conveniently transported by conveyors (preferably crane or trackless vehicles) lying between the pallet-moving equipment, which is located at the front of the cold rolling train (on the one hand) and in front of the annealing furnaces (on the other hand).

As a practical matter, the described pallet-moving equipment is positioned parallel to the longitudinal axis of the annealing furnaces, while the tracks for the loading and unloading of the annealing furnace are positioned perpendicular to the pallet-moving equipment.

There are special advantages to equipment constructed in accordance with the invention, if the mills are set with adjacent parallel roll passes and the cold rolling trains are consequently loaded from a common vertical shelf storage area, built up from an intermediate storage and, when the coils are rolled at the cold rolling train and annealed in annealing furnaces, the coils are brought to a common vertical-shelf storage area.

The advantages of the equipment for the transportation of the hot rolled strip coils in accordance with the invention, are especially noticeable, because the exact ordered arrangement of stored coils at the intermediate storage area (while waiting for their subsequent treatment) makes possible an orderly delivery in a relatively simple manner with investment costs which are not high. Because the intermediate storage needs relatively little space, the crane work is reduced, which means that at least a partial automation of the conveying procedure is possible. The result is a rational flow of the conveying steps, as is necessary in a cold rolling mill.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
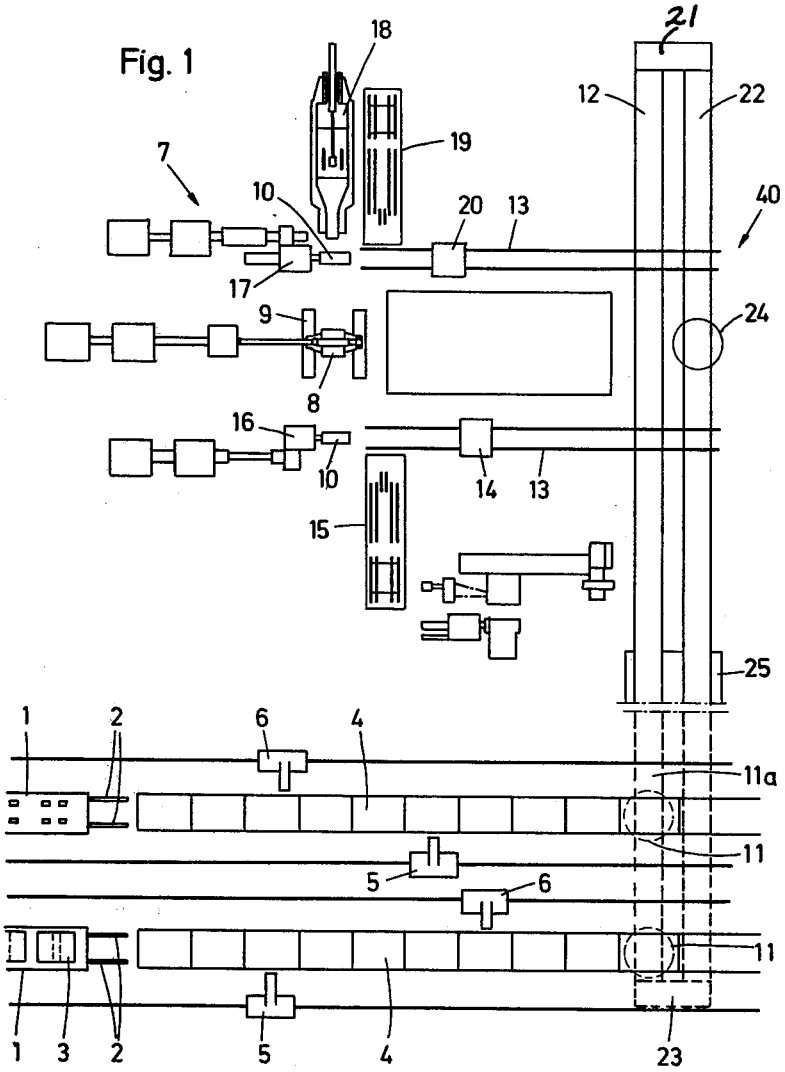
FIG. 1 is a plan view of a coil conveying apparatus constructed in accordance with the principles of the present invention.
Figure 2:
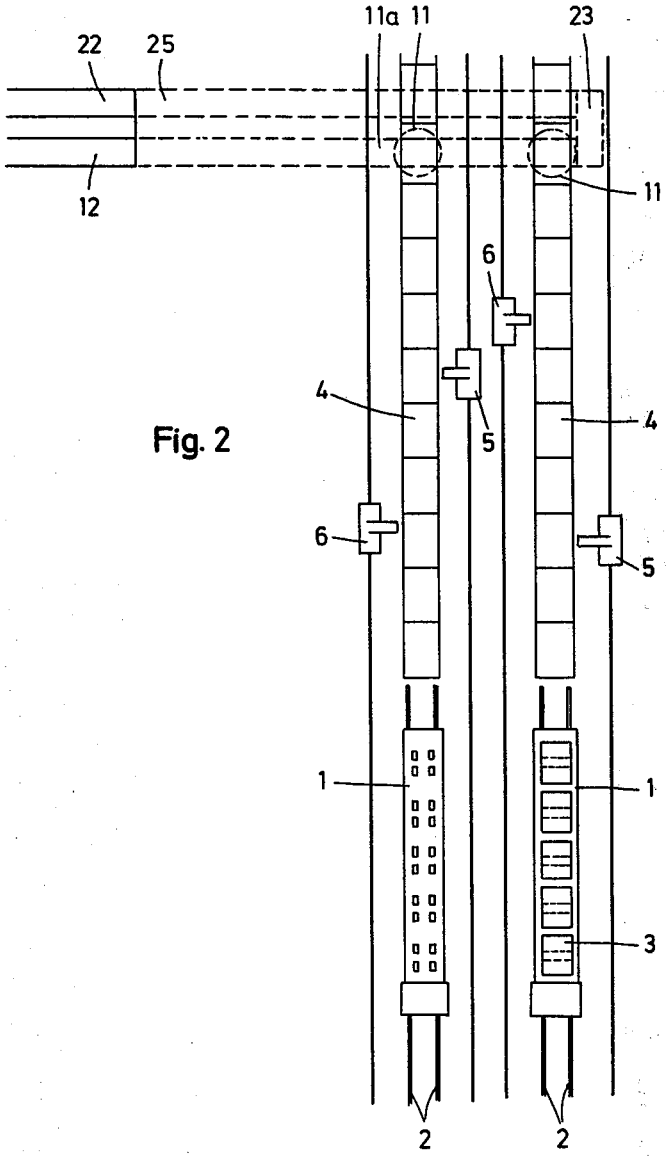
FIG. 2 is a plan view of a portion of the apparatus.

FIGS. 1 and 2 show hot rolled aluminum strip coils 3 conveyed from a hot rolling mill (not shown) to a cold rolling mill by means of a driven car 1 on tracks 2. According to the example shown, the car 1 is contructed so as to convey five coils 3. Those coils 3 (which have not yet been cooled sufficiently from the hot rolling process, where they have been heated to a temperature of 450–550° C.) have to be cooled even further before they can be cold rolled. Therefore, along the extension of the tracks 2, an intermediate storage depot is positioned in the form of multi-level shelf storage 4 with individual compartments. The vertical shelf storage can be loaded or unloaded in the direction parallel to the tracks 2 by movable loading equipment 5 and by unloading equipment 6 on the opposite side of the vertical shelf storage 4.

After the coils 3 have been cooled, they are taken in the corresponding succession by the unloading equipment 6 from the vertical shelf storage 4. As shown in FIGS. 1 and 2, the two sets of tracks 2 are parallel to and spaced from each other and also each vertical shelf storage 4 is planned to be coordinated with the loading and unloading equipment 5, 6. This means that one car 1 can be unloaded without interruption, while another car 1 returns empty on the other track 2 to the hot rolling mill.

According to FIG. 1, a single strand cold rolling train 7 is positioned near the tracks 2 and the vertical shelf storage 4 and has a pass line that is perpendicular to the axis of the rolls 8, a roll stand 9 and a reel mandrel 10 being parallel. After a coil 3 is removed from the high shelf storage 4 by the movable unloading equipment 6, the coil 3 is placed at the end of the high shelf storage 4 on a turntable 11 which is positioned within a roller conveyor 11*a*. The coil 3 is rotated 90° on the rotating table 11, to turn the opening of the coil 3 parallel to the direction of the axis of the reel mandrel 10. Then, the coil 3 is deposited, at the cropping roller conveyor 11*a*, onto a pallet and is conveyed by it along the roller conveyers 11*a* and 12. The alignment of the reel mandrel 10 is parallel to that of movable coil cars 14 resting on tracks 13, which can enter at the side of the roller conveyor 12. The coil car 14 lifts a coil 3 from the pallet at the roller conveyor 12, brings it to a coil feeding machine 15 and is slipped onto the reel mandrel 10 of the uncoiler 16.

After the strip is passed between rolls 8 in the roll stand 9, it is coiled onto a reel mandrel 10 of a recoiler 17 and is tied into a new coil by a belt wrapper 18. The coil is removed from the reel mandrel 10 of the recoiler 17 by a coil-receiving equipment 19 and is deposited on another coil car 20.

If the strip is wound into a coil and need further rolling, i.e. a second pass, it is then unloaded from the coil car 20 onto a pallet at the roller conveyor 12, and is conveyed by this roller conveyor in the rolling direction to a rear cross transfer platform 21. On this cross transfer platform 21, the coil is conveyed by the roller conveyor 22 in a direction parallel to the roller conveyor 12 (but in the direction opposite to the rolling direction) to a front cross transfer platform 23 within the range of the high shelf storage 4. Another turntable 24 is positioned within this roller conveyor 22 to rotate the coil that has already been rolled once by 180° in order to turn the leading end of the strip in the direction of rolling.

At the front cross transfer platform 23, the coil is conveyed to the roller conveyor 12 arrives again at the coil car 14, roll stand 9, etc. After the strip has gone through the last rolling pass and after it has been coiled, it is conveyed by the roller conveyor 12 to the rear cross transfer platform 21, and is removed by a conveyor (not shown), such as a crane or a trackless vehicle.

With regard to the remainder of the installation, a lowering mechanism 25, preferably with lifting tables, is positioned within the roller conveyors 12, 22 between the high shelf storage 4 and the point where the coils are being removed from the roller conveyor 12 by the coil car 14. Within this lowering mechanism 25, the coils conveyed from the turntable 11 to the roller conveyor 11*a* are withdrawn and reach the roller table 12. The conveyor brings the coil to the cross transfer platform 21, lifts it on a pallet-moving equipment (not shown) positioned in the extension of the roller conveyors 12 and 22.

Figure 4:
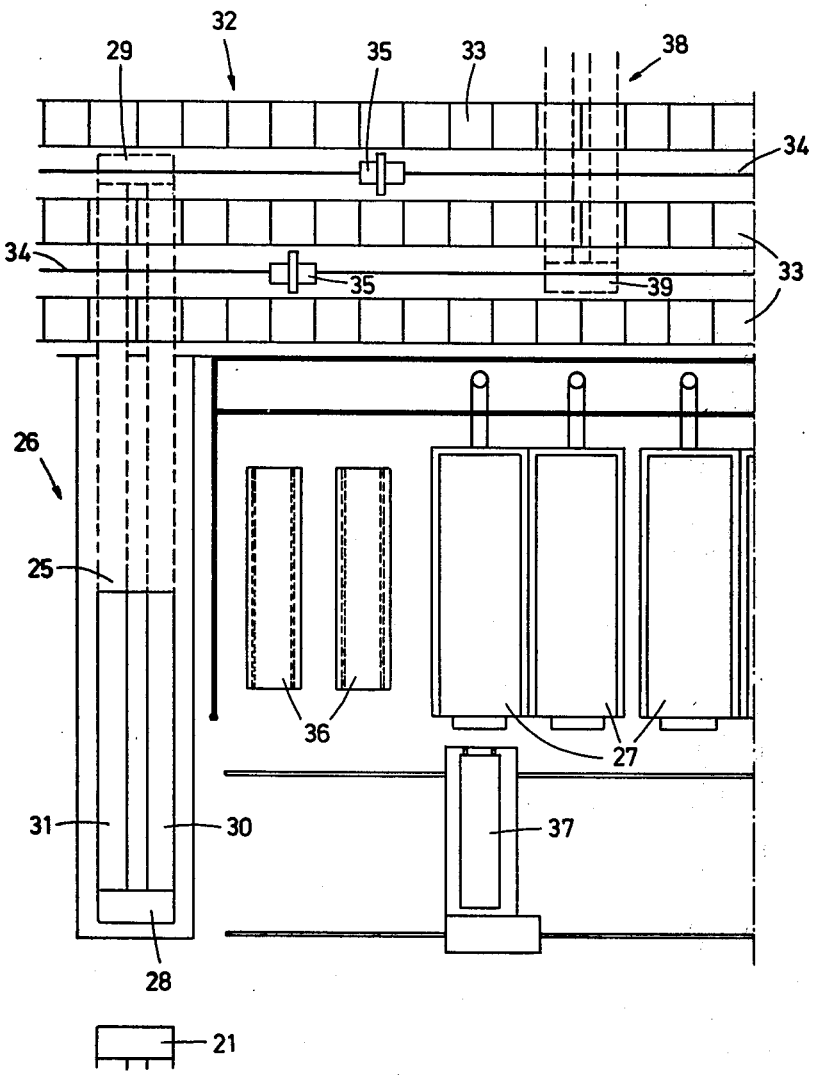

Referring to FIG. 4, the pallet-moving equipment 26, which is positioned parallel to the longitudinal dimension of a number of annealing furnaces 27, has front and rear cross transfer platforms 28 and 29, operating as the pallet turning equipment in front of the cold rolling train 7. Two roller tables 30, 31 are provided with opposite directions of movement. On the pallet turning equipment 26 and on the roller table 31, the coils, which are not annealed immediately after cold rolling, arrive at a high shelf storage 32 which is also formed as high shelves 33 and is positioned parallel to the high-shelf storage 4 at the entrance of the cold rolling mill.

As shown in FIG. 4, three rows of high shelves 33 are positioned behind each other. Between the outer and the middle row of the shelves 33, movable loading and unloading equipment 35 is carried on tracks 34 and works on both sides.

The coils to be annealed are conveyed by the roller conveyor 30 (which has a lowering mechanism 25 containing lifting tables) and a conveyor (not shown), such as a crane, to receive racks 36. From there, they are loaded into an annealing furnace 27 by means of a loading/unloading car 37 on tracks 37*a*. The tracks of the loading/unloading car 37 are also positioned perpendicular to the pallet-moving equipment 26. After the completion of the annealing process, the coils are removed from the annealing furnace 27 and are returned by the pallet-moving equipment 26 to the high shelf storage 32 for cooling.

From the high shelf storage 32, the annealed and cooled coils are conveyed by another pallet-moving equipment 38 (which is positioned parallel to the above-mentioned pallet-moving equipment 26) for further processing in a shearing line, strip stretching line, strip coating line, hardening (temper) line, or the like. The pallet-moving equipment 38 is only partly shown. Its end has a cross transfer platform 39 located between the high shelf rows 33, and extends out of the cold rolling mill bay.

Figure 3:
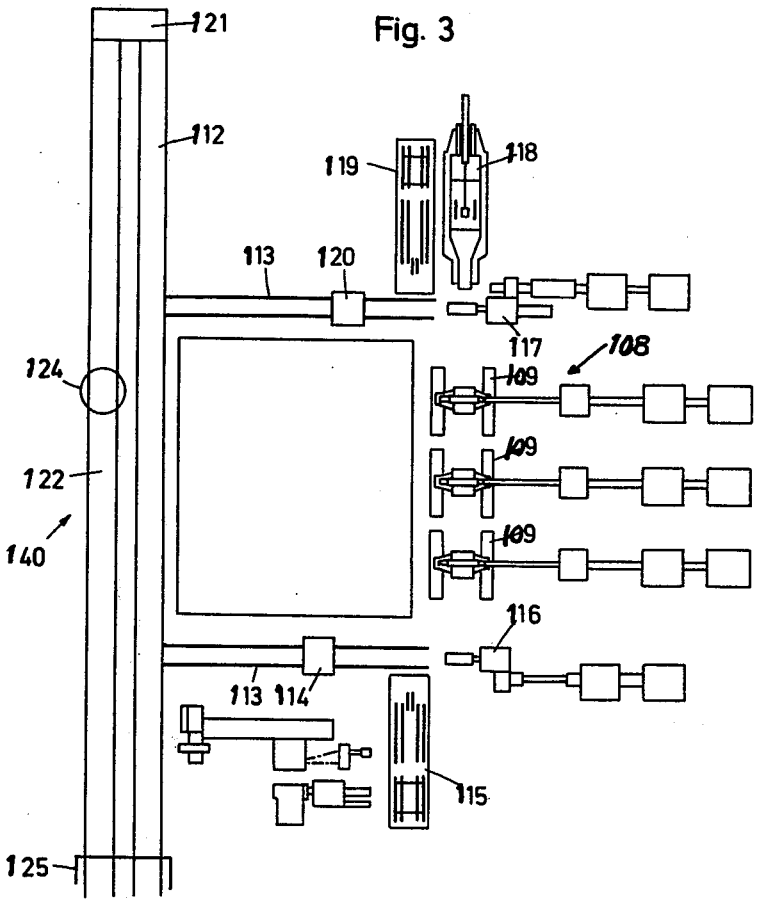
FIGS. 3 & 4 are plan views of the apparatus used for different purposes.

In FIG. 3 the pallet-moving equipment 140 with the rear cross transfer platform 121, the front cross transfer platform, and the roller conveyors 112 and 122 is actually part of shown in use with a three-strand cold rolling train 108 with roll stands 109 positioned next to each other. Also, an uncoiler and a recoiler 116 and 117, respectively, are provided at the entry and at the exit of the roll stands 109. A turntable 124 and a elevator table 125 are also provided. Just as for the single strand cold rolling train 7 of FIG. 1, the traveling coil cars 114 and 120 on the tracks 113 are installed to more perpendicular to the roller conveyor 112 to deliver and to remove the coils which are to be rolled or which have been rolled. The pallet-moving equipment 140 of the three-strand cold rolling train 108 is installed parallel to the train in the same manner as with the single-strand cold rolling train 7 of FIG. 1. Another cold rolling train can be used in the same way having, for instance, five strands, to the single-strand and to the three-strand cold rolling trains. It is then also provided with another pallet-moving equipment that is positioned parallel to the above-described pallet turning equipment 140; similarly, high shelf storage 4 and 32 which are installed perpendicularly. The high shelf storage 4 and 32 for the suggested three-strand and five-strand cold rolling trains are then extensions of the entry end of the single-strand cold rolling train 7. The high shelf storage 4 is installed, relative to the high shelf storage 32, behind the annealing furnaces 27. That is to say, the single-, three- and five-strand cold rolling trains are arranged next to each other in parallel pass lines and are loaded from the same intermediate storage. After having been rolled in the cold rolling train and annealed in the annealing furnace 27, the coils are conveyed to the same high shelf storage 33.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Apparatus for conveying strip coils, comprising:

(a) a rolling mill having an uncoiler at the entrance side and a coiler at the exit side, (b) an elongated shelf storage accessible for insertion and removal of coils from both sides, (c) coil-moving equipment consisting of two spaced, parallel, long roller conveyors joined at their ends by short cross conveyors to form an elongated closed plane figure whose long dimension is parallel to and spaced from the roll pass line of the mill, said two long roller conveyors consisting of a first long conveyor for moving coils away from the shelf storage and a second long roller conveyor for moving coils toward the shelf storage, (d) a track with a car extending from the first long roller conveyor to the uncoiler, (e) a track with a car extending from the coiler to the first long roller conveyor at a point downstream of the first conveyor, (f) loading means extending along one side of the shelf storage for inserting a coil into the shelf storage, and (g) unloading means extending along the other side of the shelf storage for removing a coil from the shelf storage and delivering it to the first long roller conveyor.

2. Apparatus as recited in claim 1, wherein the second long roller conveyor contains a turntable for . coils 180

3. Apparatus as recited in claim 1, wherein said shelf storage is arranged in two parallel rows, each row provided with conveyor means for inserting a coil and conveyor means for removing a coil, said apparatus comprising tracks with coil carrying cars associated with each shelf storage row.

4. Apparatus as recited in claim 1, wherein the first long roller conveyor contains a turntable adjacent the shelf storage for receiving coils from the unloading means.

5. Apparatus as recited in claim 1, wherein the rolling mill comprises a plurality of roll stands arranged in a roll pass line extending between the coiler and uncoiler.

6. Apparatus as recited in claim 1, wherein said elongated shelf storage comprises a primary shelf storage and said apparatus comprises:

(a) a secondary elongated shelf storage including loading and unloading equipment spaced from and extending parallel to said primary shelf storage, (b) annealing furnaces, the longitudinal axes of which extend perpendicular to the longitudinal axis of the secondary shelf storage, (c) means for loading coils into and unloading coils from the annealing furnaces, and (d) means for conveying coils from the coil moving equipment to the secondary shelf storage and from the secondary shelf storage to the furnace loading and unloading means.

7. Apparatus as recited in claim 6, wherein the furnace loading and unloading means comprises:

(a) tracks located in the front of the annealing furnace openings and extending perpendicular to the axes of the furnace, and means for conveying coils from the secondary shelf storage, (b) a loading and unloading car on the tracks, and (c) racks for receiving coils and for transport on the car.

* * * * *

UNITED STATES PATENT AND TRADEMARK OFFICE

CERTIFICATE OF CORRECTION

PATENT NO. : 4,152,919

DATED : May 8, 1979

INVENTOR(S) : Wilfried Bald and Hans Pölking

It is certified that error appears in the above-identified patent and that said Letters Patent are hereby corrected as shown below:

Claim 2, line 2 of the patent, change: ".coils 180" to --- rotating coils 180°. ---

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*